United States Patent [19]

LaRoche et al.

[11] Patent Number: 4,848,044

[45] Date of Patent: Jul. 18, 1989

[54] EXPANSION JOINT COVER

[75] Inventors: Allan R. LaRoche, Roseville, Calif.; Robert A. Butcher, Turner, Me.; Jean A. Dubuc, Lewiston, Me.; Douglas S. Pearmain, Auburn, Me.

[73] Assignee: Manville Corporation, Denver, Colo.

[21] Appl. No.: 219,500

[22] Filed: Jul. 14, 1988

[51] Int. Cl.[4] ..... E04B 1/68; E04D 3/38

[52] U.S. Cl. ..... 52/58; 52/403; 52/396; 404/68

[58] Field of Search ..... 52/403, 396, 58, 573, 52/317; 165/131, 81; 404/53, 54, 56, 68, 69

[56] References Cited

U.S. PATENT DOCUMENTS

| | | | |
|---|---|---|---|
| Re. 25,733 | 2/1965 | Patry et al. . | |
| 3,300,913 | 1/1967 | Patry et al. . | |
| 3,319,330 | 5/1967 | Patry et al. . | |
| 3,346,941 | 10/1967 | Patry et al. . | |
| 3,355,846 | 12/1967 | Tillson | 52/403 |
| 3,410,037 | 11/1968 | Empson et al. | 52/403 |
| 3,468,285 | 9/1969 | Patry et al. . | |
| 3,581,450 | 6/1971 | Patry | 52/58 |
| 3,964,220 | 6/1976 | Rutkowski et al. | 52/256 |
| 4,129,967 | 12/1978 | Barlow | 52/396 |
| 4,189,877 | 2/1980 | Jentoft et al. | 52/58 |
| 4,332,504 | 6/1982 | Arai | 52/396 |
| 4,706,432 | 11/1987 | Fishburn | 52/544 |
| 4,750,301 | 6/1988 | Croxford | 52/58 |

FOREIGN PATENT DOCUMENTS

| | | | |
|---|---|---|---|
| 500672 | 2/1951 | Belgium | 52/403 |
| 2114188 | 5/1973 | Fed. Rep. of Germany | 52/403 |

*Primary Examiner*—David A. Scherbel
*Assistant Examiner*—Caroline D. Dennison
*Attorney, Agent, or Firm*—John D. Lister; Cornelius P. Quinn; Gregory A. Evearitt

[57] ABSTRACT

An expansion joint cover having a vapor barrier channel depending from the bellows membrane. Resilient insulation substantially fills the channel, making it possible to attach an insulated vapor-impermeable bellows cover to the expansion joint members in a single operation. A separate layer of foam insulation may be bonded to the underside of the bellows independent of the insulation filling the channel.

9 Claims, 2 Drawing Sheets

EXPANSION JOINT COVER

FIELD OF THE INVENTION

This invention relates generally to expansion joints. More particularly, it relates to insulated expansion joints and to expansion joint covers for use therewith.

BACKGROUND OF THE INVENTION

Many building structures incorporate expansion joints to accommodate the movement of structural elements as a result of temperature changes or seismic activity. In order to prevent moisture from entering the expansion joints, it is necessary to protect the joints with a waterproof cover. Typical expansion joint covers comprise an elongated bellows the side edges of which are connected to metal mounting flanges. The flanges are attached to support members of the building structure which are spaced from each other on either side of the expansion joint, so that when the support members move relative to each other the bellows will be able to yield or flex with the movement. Because the bellows remains attached to the support members during such movement, the expansion joint cover continues to protect the expansion joint against the entry of moisture.

In addition to waterproofing expansion joints, many architectural and engineering structural designs require the joint to be insulated. For the insulation to be effective for any length of time it is also necessary to provide a vapor barrier to prevent moisture in the form of condensate from the interior environment of the building from entering the insulation. Therefore, it is common practice when installing an expansion joint cover under these conditions to first drape a vapor barrier into the joint opening and to then stuff the joint opening above the vapor barrier with insulation. Then the preformed expansion joint cover is attached to the structural elements on either side of the joint opening.

Not only is this procedure time consuming, and therefore not economically desirable, it is also difficult to maintain high standards of quality control. As long as the installation procedure requires the joint cover to be fabricated in the field, these problems will continue to exist. Until the present invention, there had been no satisfactory way of overcoming the drawbacks of this conventional practice.

SUMMARY OF THE INVENTION

This invention provides an expansion joint cover which includes insulation and vapor barrier means as an integral part. The various functions required of an expansion joint can thus be supplied simply by installing a preformed cover. The expansion joint cover includes an elongated bellows having side edges attached to flange means. The flange means are connected to structural support members on either side of the expansion joint when the expansion joint cover is installed. Attached to the expansion joint cover adjacent the side edge portions of the bellows are the side edge portions of an elongated vapor barrier sheet which hangs or drapes down to form an elongated channel. Compressible, resilient insulation substantially fills the channel.

With this arrangement it is merely necessary for workmen to install the expansion joint cover in the same manner that the bellows alone have been installed for years, simply attaching the flanges of the assembly to the structural members one either side of the expansion joint. Since it is no longer necessary to separately install the various components of an expansion joint cover at the building site, the resulting cover is easier and and faster to install and is of uniform high quality. Modifications to the assembly may be made, including variations in the channel design and in the manner of securing the side edges of the vapor barrier channel to the expansion joint cover, as explained in more detail hereinafter.

Other features and aspect of the invention, as well as other benefits of the invention, will readily be ascertained from the more detailed description of the invention which follows.

DESCRIPTION OF THE PREFERRED EMBODIMENTS

Figure 1:
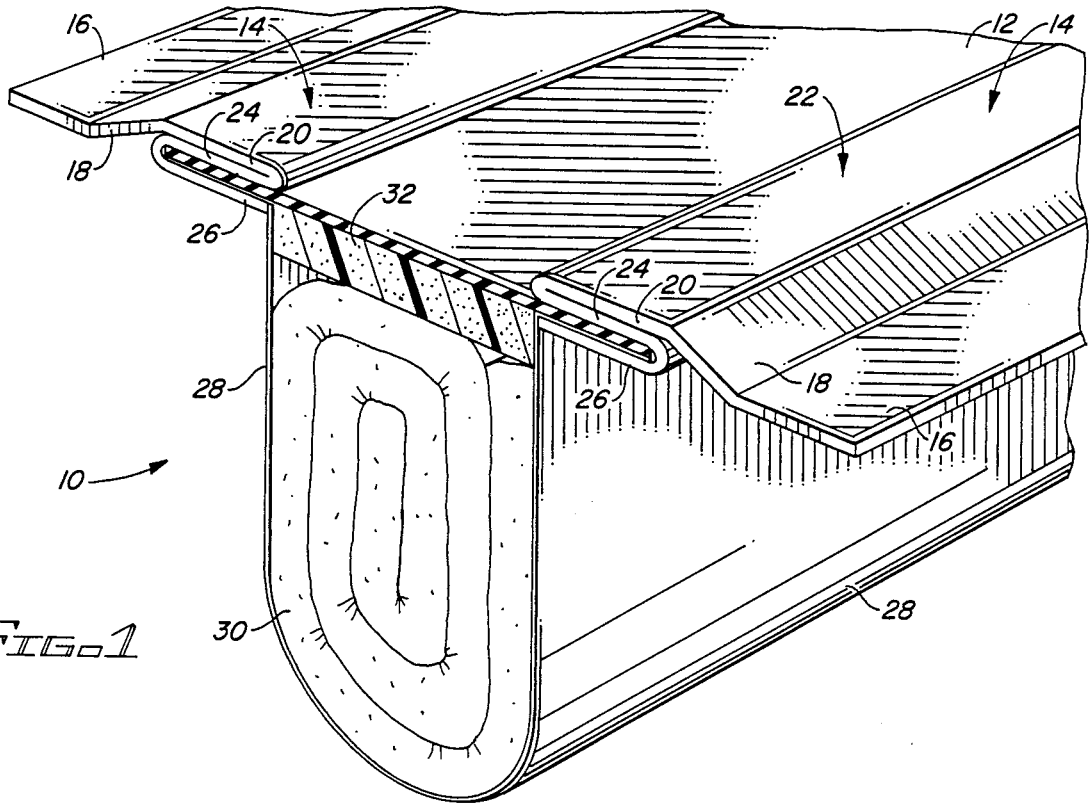
FIG. 1 is a partial pictorial view of the expansion joint cover of the present invention.

Referring to FIG. 1, the expansion joint cover 10 of the present invention comprises an elongated bellows 12 the side edge portions of which are attached to flanges 14. The bellows may be formed of any suitable flexible material which has adequate resistance to the weather and which is strong enough to resist the stresses to which it is exposed during service. Examples of suitable materials are an elastomeric membrane such as a 60 mil sheet of neoprene or EPDM, or a 31.5 mil Tedler/Nitrite laminated sheet.

The mounting flanges 14 are fabricated from a single metal sheet which is folded upon itself to form a bifurcated edge for receiving the side edge portions of the bellows 12. The flange comprises a flat outer edge portion 16 of single thickness connected by a sloped transition portion 18 to the upper or outer portion 20 of the folded section 22. The outer portion 20 is folded upon itself to form an interior flange section 24, which is folded back to form the lower or inner flange section 26. The sections 24 and 26 are spaced apart to form the bifurcated edge for receiving the side edge portion of the bellows 12. Such an arrangement and its manufacture are described in more detail in U.S. Pat. Nos. 3,346,941 and 3, 468,285 to Patry et al. If desired, the flange section 26 may be crimped to increase the holding power of the bifurcated edge joint. Such an arrangement, including gripping teeth resulting from a flange piercing operation, is disclosed more fully in application Ser. No. 900,936, filed Oct. 17, 1986 and assigned to the assignee of this application.

Although the arrangement depicted is preferred due to its simplicity and ease of manufacture, it is not essential that the bifurcated edge opening be formed by folding the edges of a metal sheet. For example, U.S. Reissue Pat. No. Re. 25,733 to Patry et al disclosed bifurcated edge designs formed from both folded and nonfolded sheets. However formed, the bifurcated edge clamp should be watertight and can be formed of any material suitable to the installation, such as galvanized steel, stainless steel, copper and aluminum. It is also contemplated that a suitable adhesive may be used to further secure the side edge portions of the bellows in the bifurcated edge of the flanges as described in more detail in the above-mentioned patents.

Still referring to FIG. 1, an elongated flexible vapor barrier sheet 28 has side edge portions which are also received in the bifurcations of the flanges 14 and held in place along with the edge portions of the bellows 12. The width of the vapor barrier sheet 28 causes the sheet to depend a substantial distance from the flanges in a trough-shaped configuration so as to form a channel with the underside of the bellows 12. The channel is substantially filled with compressible resilient insulation 30 which is sufficiently compressed to exert an outward force on the faces of the channel. It will be noted that in the preferred form of the invention the bellows 12 has a layer of insulation 32 adhered to its underside, so that in such an arrangement the insulation 30 actually contacts the layer of insulation 32 rather than the membrane 12.

The vapor barrier sheet may comprise any desired flexible sheet which is not permeable to moisture and which offers sufficient tear resistance and puncture resistance to withstand the stresses to which it is subjected during installation and service. Examples of suitable materials are neoprene impregnated fabric, vinyl and MYLAR sheets.

The insulation contained in the channel formed by the vapor barrier and the bellows may be any insulation that has adequate insulating properties and which is sufficiently light in weight so as to be supported by the vapor barrier sheet. It should be sufficiently compressible to enable it to be further compressed by movement of the structural building components toward each other, and sufficiently resilient to enable it to recover as the building components move away from each other, in all cases being maintained in at least slightly compressed condition so as to maintain contact with the vapor barrier sheet and the bellows. Suitable inorganic fibrous material such as low density glass fiber or refractory fiber insulation is preferred, although low density foam insulation having the necessary resiliency could also be used. Such material can be inserted into the vapor barrier trough either prior to or after the vapor barrier sheet is attached to the mounting flanges. Although fibrous insulation batts could be used, insulation in roll form is preferred for ease of handling during assembly of the expansion joint cover.

The insulation layer 32, although not essential to the invention, is preferred to be used in installations requiring a fully insulated expansion joint cover. It not only adds to the insulating value of the assembly, but in addition acts as a support for the membrane of the bellows 12. The insulation layer 32 preferably is comprised of suitable foam insulation which has some structural rigidity and can also be flexed or bowed into arcuate shape during installation and during movement of the structural building components. Examples of such a foam are closed cell polyethylene or closed cell neoprene.

Figure 2:
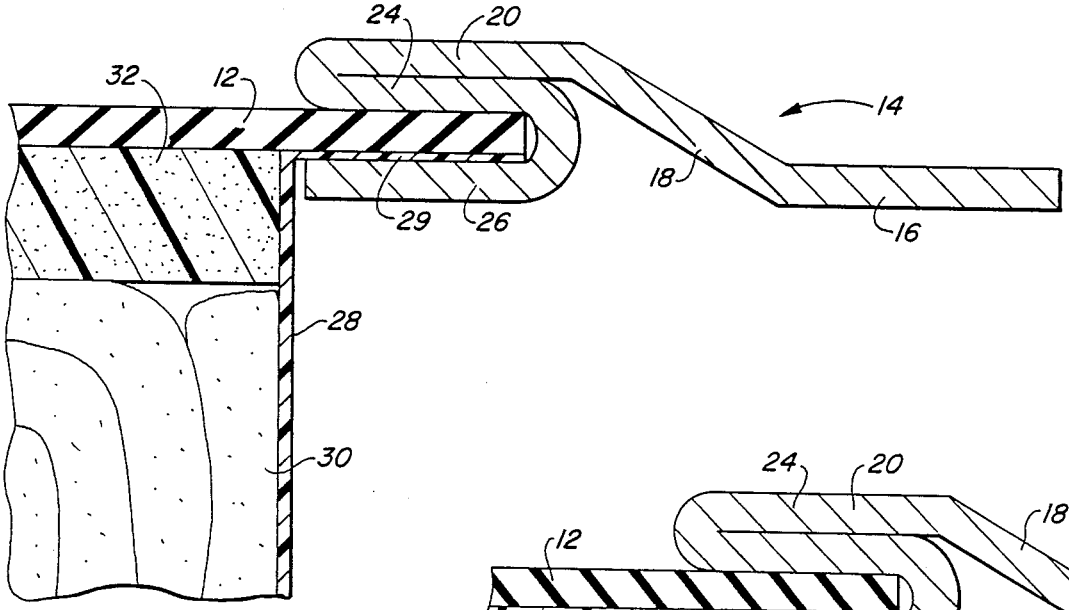
FIG. 2 is an enlarged partial transverse sectional view taken through the right flange and connected edge portions of the bellows and vapor barrier sheet of FIG. 1.

Referring now to FIG. 2, it can be seen that the side edge portion of the bellows 12 is received in the bifurcation of the mounting flange 14 formed by the space between the folded sections 24 and 26. In addition, the side edge portion 29 of the vapor barrier sheet 28 is also received in the same space, between the lower side of the bellows 12 and the lower flange section 26. The clamping arrangement of the bifurcation is sufficient to hold the trough formed by the vapor barrier sheet in suspended condition. Although not shown, it will be understood that the side edge portions of the vapor barrier sheet would also be held in place by any adhesive which may be used to supplement the gripping engagement of the bellows 12 by the bifurcated mounting flange.

Figure 3:
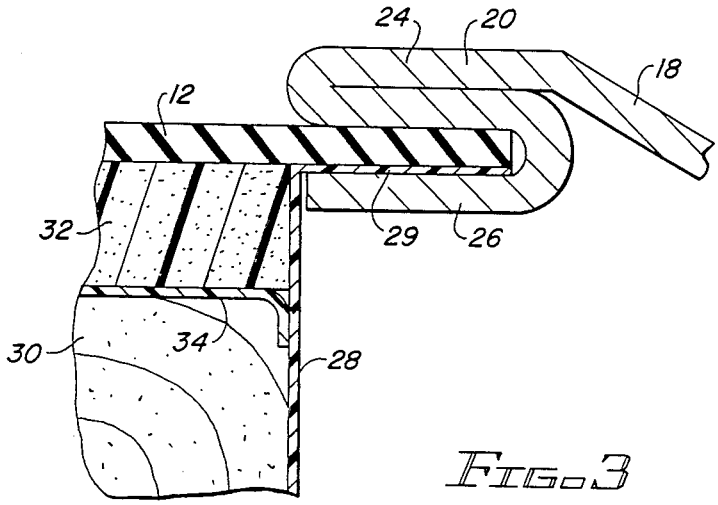
FIG. 3 is an enlarged partial sectional view similar to that of FIG. 2, but showing a modified vapor barrier channel design.

Instead of forming the vapor barrier sheet into the shape of a trough, as in FIGS. 1 and 2, the sheet may be formed so as to comprise its own enclosed sleeve channel. This arrangement is illustrated in FIG. 3, wherein an upper sheet portion 34 connects the side walls of the trough to close off the trough into sleeve form. The side edge portions 29 of the vapor barrier sheet 28 extend upwardly to the mounting flange as in the arrangement of FIGS. 1 and 2. The upper sheet portion 34 would be connected as by sewing, in the case of a fabric, or by heat seal, in the case of an elastomeric sheet. The upper portion 34 would preferably be located so as to engage the underside of the bellows 12 or, if present, the underside of the insulation layer 32.

Figure 4:
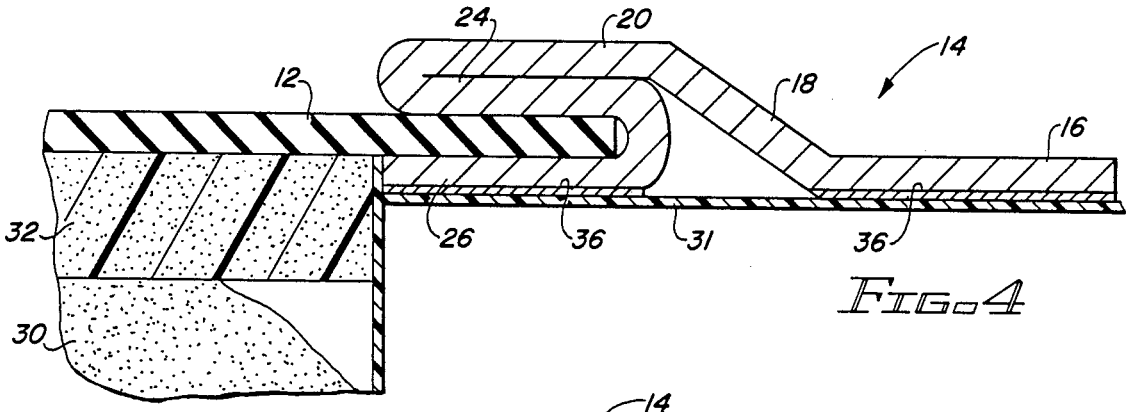
FIG. 4 is an enlarged partial sectional view similar to that of FIG. 2, but showing a modified arrangement for attaching the vapor barrier sheet to the expansion joint cover.

If desired, the side edge portions of the vapor barrier sheet need not be secured in place by the same bifurcated clamp arrangement which grips the side edge portions of the bellows but may be attached directly to the mounting flanges. As shown in FIG. 4, the side edge portions 31 of the vapor barrier sheet 28 are adhered to the bottom surface of the mounting flanges 14 by suitable adhesive 36, preferably a contact cement. Although the side edge portion 31 is shown as extending substantially to the outer edge of the mounting flange, thereby being adhered to the bottom surfaces of the outer edge portion 16 and the lower flange section 26, it may be adhered only to the section 26 if the dimensions of the flange, the strength of the sheet and the holding power of the adhesive 36 are adequate to support the insulation-filled vapor barrier trough. Although this embodiment is shown in connection with the channel design of FIG. 2, it will be appreciated that it could be used in connection with the channel design of FIG. 3 as well.

Figure 5:
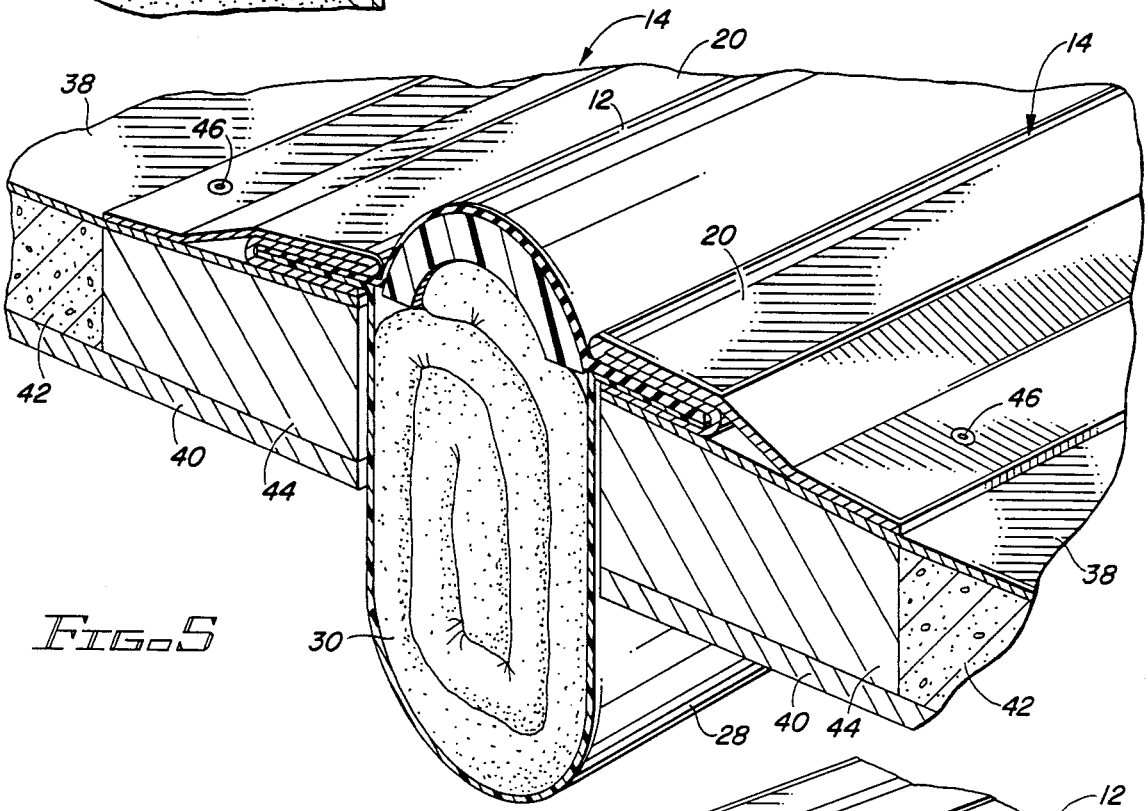
FIG. 5 is a partial pictorial view showing the expansion joint cover of FIG. 1 installed on a building structure.

Referring to FIG. 5, the expansion joint cover is shown in installed condition on a roof. The mounting flanges 14 overlie a roofing membrane 38 which is adhered to mounting blocks 44 and adjacent roof insulation boards 42. Beneath the mounting blocks and insulation board is the roof deck 40. To install the expansion joint cover the assembly is put into place so that the mounting flanges 14 are pushed toward each other, resulting in the bellows 12 and insulation layer 32 bowing upwardly as shown. The mounting flanges are then secured to the mounting blocks 44 on either side of the expansion joint, for example by using mechanical fasteners 46 to attach the flanges to the mounting blocks 44 at intervals along the length of the expansion joint cover. The insulation 30, being highly compressible, is squeezed to the resulting narrower shape of the vapor barrier trough and extends up into the concave space formed by the flexing bellows 12 and insulation layer 32.

Upon subsequent movement of the support members toward each other, the bellows 12 and insulation layer 32 are flexible enough to bow to an even greater extent, sufficient to withstand the maximum movement for which the joint was designed. The insulation 30 in such case is readily compressed the necessary amount. If after the installation of the expansion joint cover the support members move away from each other, the bellows and insulation layer will readily spring back the amount necessary to lessen the curvature of the bowed portion. The insulation 30 has enough resiliency to recover or spring back to maintain the insulation in contact with the channel formed by the vapor barrier.

Figure 6:
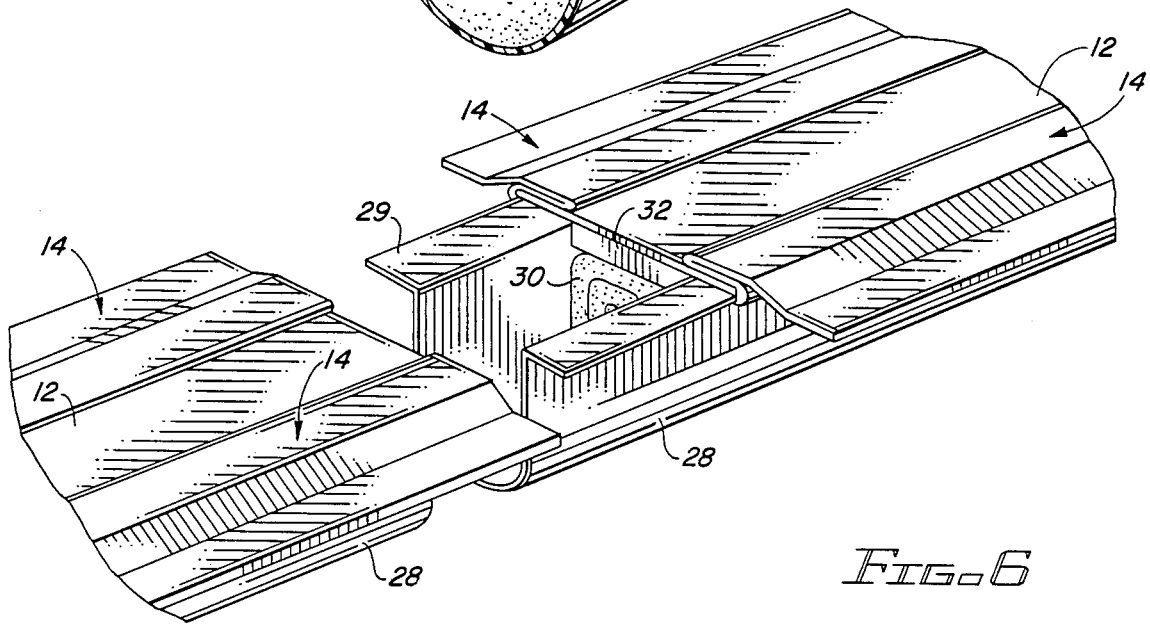
FIG. 6 is a partial pictorial view of the end portions of adjacent lengths of expansion joint covers, showing the overlapping arrangement of the vapor barrier channel ends prior to abutment of the adjacent lengths.

When the expansion joint is relatively long and requires more than one length of an expansion joint cover to be used, the ends of the bellows and the insulation 30 are abutted, with the butt joint later being covered with flashing to maintain a water tight seal. As shown in FIG. 6, the vapor barrier sheet 28 is extended beyond one of the ends of the length of expansion joint cover of which it is a part, as at 28', so that it can overlap the end of the adjacent vapor barrier sheet. In this way the continuity of the vapor barrier is preserved between lengths of expansion joint covers. Only a relatively small overlap is needed to accomplish this, in the order of 4–6 inches.

It should now be apparent that the invention provides a simple but highly effective way of installing insulated expansion joint covers. By preassembling the joint covers the quality control is improved and the installation time is shortened. Yet the design of the expansion joint cover permits factory assembly without radical changes to the existing facilities for manufacturing the bellows and mounting flange assembly. It is merely necessary to attach the side edge portions of the vapor barrier sheet to the mounting flanges during manufacture of the bellows and mounting flange assembly, and then subsequently to insert rolls or batts of insulation into the channel produced by the vapor barrier.

It should be understood after reading the foregoing description that the invention is not necessarily limited to all the specific structural details described, but that changes to certain features of the preferred embodiments which do not affect the overall function and concept of the invention may be made by those skilled in the art without departing from the spirit and scope of the invention, as defined by the appended claims.

What is claimed is:

1. An integral exterior expansion joint cover assembly, comprising:

an elongated bellows having side edge portions;

flange means attached to the side edge portions of the bellows, the flange means adapted to be connected to spaced members of an expansion joint;

an elongated flexible vapor barrier sheet having side edge portions attached to the expansion joint cover adjacent the side edge portions of the bellows, the vapor barrier sheet depending from the expansion joint cover in the shape of an elongated channel; and compressible and resilient insulation substantially filling the channel;

the flange means includes bifurcations, the side edge portions of the bellows and the side edge portions of the vapor barrier sheet being held in place in the bifurcations;

the integral assembly being adapted to be installed as a unit to cover an exterior expansion joint.

2. An expansion joint cover assembly according to claim 1, wherein the side edge portions of the vapor barrier sheet are adhered to the flange means by an adhesive bond.

3. An expansion joint cover assembly according to claim 1, including a layer of insulation separate from the insulation substantially filling the vapor barrier channel, the layer of insulation being adhered to the bellows and being capable of assuming an arcuate shape when the side edge portions of the bellows are moved toward each other.

4. An expansion joint cover assembly according to claim 1, including a vapor barrier sheet covering the insulation filling the elongated channel, whereby the insulation is fully enclosed by the vapor barrier sheet.

5. An expansion joint cover assembly according to claim 1, wherein the elongated channel comprises a trough formed of the vapor barrier sheet, with the bellows closing the upper portion of the trough.

6. An expansion joint cover assembly according to claim 1, wherein the vapor barrier sheet, the bellows and the insulation have end portions, the end portions of the bellows and the insulation being substantially aligned, the associated end portion of the vapor barrier sheet extending beyond the aligned ends of the bellows and the insulation to provide for the overlapping of the extended vapor barrier sheet and the end portion of an adjacent length of expansion joint cover.

7. An expansion joint cover assembly according to claim 1, wherein the compressible and resilient insulation is comprised of inorganic fibers.

8. An expansion joint cover assembly according to claim 1, wherein the compressible and resilient insulation is comprised of foam material.

9. An expansion joint cover assembly according to claim 3, wherein the layer of insulation comprises a relatively thick layer of foam bonded to the surface of the bellows opposite the outer surface of the bellows.

* * * * *